United States Patent [19]

Kikuchi

[11] 4,068,880

[45] Jan. 17, 1978

[54] AUTOMATIC DRUM GRIPPER

[76] Inventor: Takefusa Kikuchi, 3-6-18, Sakai, Musashino, Tokyo, Japan

[21] Appl. No.: 731,689

[22] Filed: Oct. 12, 1976

[30] Foreign Application Priority Data

Feb. 28, 1976 Japan ..... 51-15827

[51] Int. Cl.[2] ..... B66C 1/42

[52] U.S. Cl. ..... 294/90

[58] Field of Search ..... 294/90, 67 R, 67 A, 294/67 AA, 67 AB, 67 DA, 81, 91, 92, 103, 15, 104; 214/650, 654

[56] References Cited

U.S. PATENT DOCUMENTS 3,338,616 8/1967 Ericson ..... 294/90

FOREIGN PATENT DOCUMENTS 914,374 1/1963 United Kingdom ..... 294/90

*Primary Examiner*—James B. Marbert
*Attorney, Agent, or Firm*—Ira Milton Jones

[57] ABSTRACT

In an apparatus to hold and transport a drum, by gripping its chime, a gripper bracket to hold a drum, being installed with the main gripping and releasing mechanism to play the leading role, is suspended by a lifting bracket through a spring and also supported vertically freely through a pin-elliptical hole joint.

The mechanism, to play the leading role, consists of a gripper bracket, a pair of gripping levers, each of which having a gripper jaw to grip a chime of a drum and a connecting lever, being pin jointed with each other to make a quadrilateral link mechanism.

The mechanism, to play the support's role during the operation, is the releasing apparatus, consisting of a jaw releaser suspended by the lifting bracket through a pin-elliptical hole joint and connected with the quadrilateral link by a spring, of a jaw releaser stopper, equipped on the gripper bracket and of a disengaging slider pusher, equipped on the lifting bracket, cooperates with the action of the gripper bracket with quadrilateral links in releasing and gripping performances.

2 Claims, 6 Drawing Figures

AUTOMATIC DRUM GRIPPER

The object of this invention is to provide a device to hold or release a drum automatically by a lifting or lowering operation; or more precisely, by lifting or lowering the device alongside the drum in an upright position. The device automatically holds or releases a drum by gripping or releasing its chime.

Such devices to hold a drum by gripping its chime are known, as e.g., U.S. Pat. No. 2,779,494 "Hand Trucks For Drums" and U.S. Pat. No. 3,333,883 "Drum Gripper" but in these devices, gripping, locking and releasing are effected manually.

In this device, as above mentioned, the gripping and releasing are quite automatically operated by the action of gravity in cooperation with the tension of springs.

Figure 1:
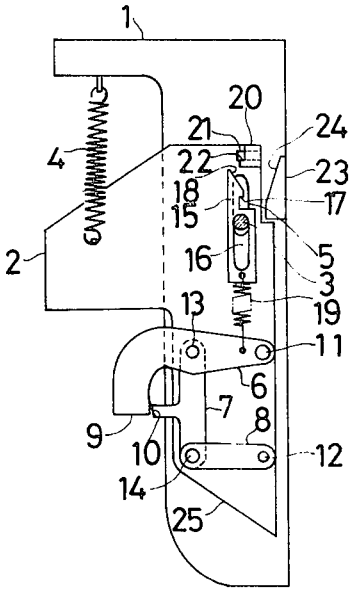

This invention is illustrated in the accompanying drawings, in which,

FIG. 1. The side elevation.

Figure 2:
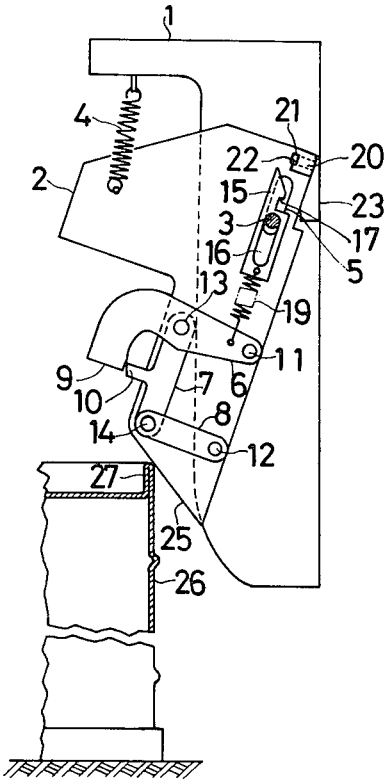

FIG. 2. The state of the apparatus with no load and ready for the lowering operation to hold a drum.

Figure 3:
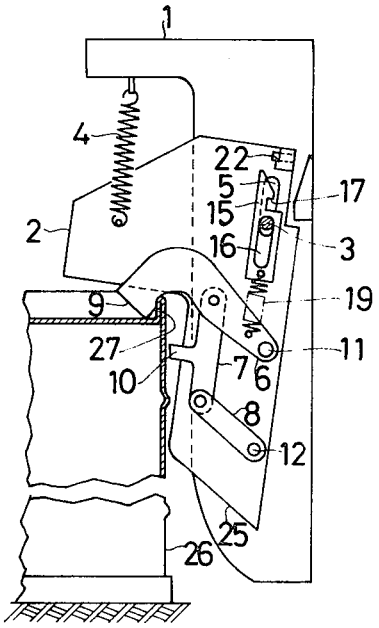

FIG. 3. The state when the apparatus with no load is lowered to the lowest position, where the upper jaw lies on the cover plate, and the lower jaw faces the barrel of a drum.

Figure 4:
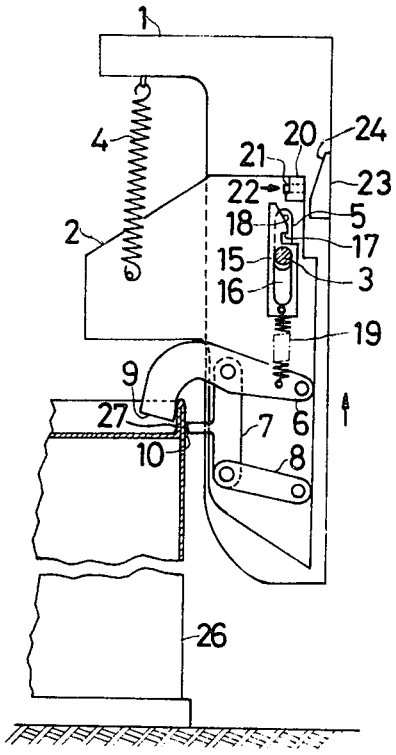

FIG. 4. The state of lifted drum, whose chime is firmly gripped by both jaws.

Figure 5:
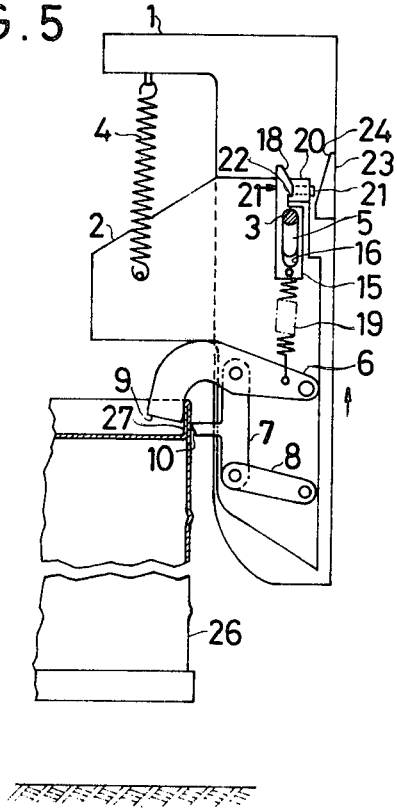

FIG. 5. The releaser hook mates with the stop jaw.

Figure 6:
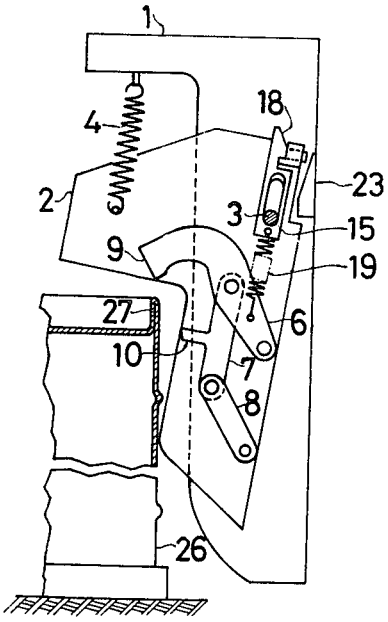

FIG. 6. Both jaws of the gripper levers have just released the chime.

The gripper bracket 2, of an inverted L shape, is supported at its left side, by a lifting bracket 1 through a coil spring 4, and at its right side, through a guide pin 3, fixed on the lifting bracket 1 and mated with an elliptical hole 5, vertically drilled along the upper right corner of the gripper bracket.

Thus, due to the elongation and contraction of the spring 4 and due to the up and down shifting along the elliptical hole 5 around the guide pin 3, the gripper bracket 2, which performs the main function of this device, swings and is able to shift to and hold the most suitable position automatically to conform to various conditions, during the operation.

This is one of the most important characteristics of this invention.

A pair of gripping jaw levers, the upper 6 and the lower 7, is provided on this gripper bracket.

The jaw lever 6, which is bent downwards along its left half and has an upper jaw 9 at the end, is pin jointed to the gripper bracket 2 by a pin 11. A connecting link 8 is also pin jointed to the gripper bracket by a pin 12. The lower jaw lever 7 connects with the gripper jaw lever at its middle and with the link 8 at its left end by pins 13 and 14 respectively, composing a quadrilateral link mechanism 11-12-14-13.

The lower jaw lever 7 has a lower gripping jaw 10, projecting to the left at the middle of the lever, to face the upper gripping jaw 9, and thus to grip the chime 27 of a drum 26.

The upper end of a jaw releaser 15 is cut obliquely on its right side, to form a slope 18. Under this slope, the releaser is cut to form a downward hook 17, which is so arranged as to mate with a stop jaw 22 of a jaw releaser stopper 20, which is equipped at the upper right corner of the gripper bracket 2.

The jaw releaser 15, described as above, is supported by the guide pin 3, fixed on the lifting bracket 1, through an elliptical hole 16, which is longitudinally drilled in the jaw releaser 15.

The jaw releaser 15 is connected at its lower end with the upper jaw lever 6, by a spring 19, which is able to turn the link mechanism, including the upper jaw lever 6, the link 8 and the lower jaw lever 7 clockwise against gravity around the pins 11 and 12, when the jaw releaser hook 17 of jaw releaser 15 mates with the stop jaw 22 of the jaw releaser stopper 20.

As shown in FIG. 2, the drum gripper device, whose lifting bracket 1 is installed e.g., on a fork of a fork lift, is just going to be lowered down to pick up a drum 26, standing on the ground, by gripping its chime 27.

In the apparatus with no load, the jaw releaser 15 is disengaged from the jaw releaser stopper 20, and being supported by the pin 3, it takes its lowest position, letting the spring 19 free. Thus, the upper jaw lever 6, the lower jaw lever 7 and the connecting link 8 come down by the gravity, until the upper jaw 9 comes in contact with the lower jaw 10.

The gripper bracket 2, with the gripping jaw link mechanism in the above mentioned state, is hung, at its left side, on the lifting bracket 1 by a spring 4, and turns clockwise around the guide pin 3. Thus the lower part of gripper bracket 2, including its gripping mechanism, becomes located outside of the lifting bracket towards the left.

Now the lifting bracket 1 is lowered down alongside a drum 26 standing on the ground, its left side being kept close to the drum, then the inclined edge 25 of the gripper bracket is pushed towards the right by the chime 27 of the drum, and the gripper bracket turns counterclockwise around the guide pin 3. As the gripper bracket is thus lowered downwards, the lower jaw 10 is pushed upwards by the chime. Then the upper jaw lever 6 is pushed upwards by the lower jaw lever 7 and turns clockwise around the pin 11 by the quadrilateral link mechanism, and separates the upper jaw 9 from the lower jaw 10, to let the chime come in between the two jaws.

The gripper bracket is thus lowered until the upper jaw 9 touches the cover plate of the drum as shown in FIG. 3.

In this state, it is to be mentioned that the gripper bracket 2 is suspended only through the spring 4 and freely supported through the pin-elliptical hole joint by the lifting bracket 1, and "swings" as already mentioned.

The spring 4 is so adjusted as only to suspend the gripper bracket and not to lift it to change the state of equilibrium of the link mechanism during this first stage of lifting operation.

Now the lifting bracket begins to be lifted. The upper jaw lever is pulled downwards by its own gravity weight and its jaw 9 comes nearer to the lower jaw 10, by the quadrilateral link mechanism, till at last, the two jaws stand face to face with each other across the chime, the upper, contacting the inside and the lower, the outside of the chime.

This is the first stage of gripping of jaws, where the gripping is only apparent, due to their own weights of the levers and link.

Now, the lifting bracket 1 is lifted until the guide pin 3 reaches the top inside of the elliptical hole 5 of the gripper bracket 2.

The gripper bracket is then slightly lifted, whereupon the weight of the barrel strongly acts as the gripping force on the jaws through the quadrilateral link mechanism, and the jaws firmly grip, or it may well be said bite the chime of the drum, as shown in FIG. 4.

As the weight of the drum is transferred from the floor to the lifting apparatus, the latter is prepared for the unloading operation.

The jaw releaser 15, being urged downwards at its lower end by the upper jaw lever 6 through the spring 19, is nevertheless shifted upwards by the guide pin 3, acting on the upper inside of the elliptical hole 16. As the jaw releaser 15 moves up, it is pushed by the jaw releaser stopper 20 acting against its upper right slope, to be tilted until its hook 17 reaches the stop jaw 22 of the jaw releaser stopper 20. The tilted releaser, by the tension of the spring 19, now recovers its vertical position, and the releaser hook 17 mates with the stop jaw 22, shifting the disengaging slider 21 to the right, as shown in FIG. 5.

Thus the apparatus, holding the drum and being prepared for unloading the drum, is ready to be securely transported by a fork or a crane to any place, and to be lowered and unloaded.

The loaded apparatus is thus transported to its destination and is lowered down on the floor. The drum, now resting on the floor, the gripping force by the upper and lower jaws becomes zero, and as the lifting bracket is further lowered the upper jaw lever 6 is pulled upwards by the spring 19, and at the same time the lower jaw lever 7 is shifted rightwards through the quadrilateral link mechanism, and the chime is released from the two jaws 9 and 10.

In this state, the lower jaw 10 is so arranged as not to come out of the left side of the gripper bracket 2 as shown in FIG. 6.

Thus the apparatus has finished its first transportation.

In the unloaded apparatus, as the gripper bracket 2 is suspended at the left side by the spring 4, it tilts towards the right and its left downward corner touches the drum wall. In this state, the apparatus is vertically lifted, and when the left corner and the inclined edge 25 of the gripper bracket passes upwards above the tip of the chime, the gripper bracket, suspended by the spring 4 at its left, and supported by the guide pin 3 and elliptical hole 16, tilts to the right, until it rests at its upper right side upon a slant 24 formed at the upper left side of a disengaging slider pusher 23, as shown in FIG. 2, and pushes a disengaging slider 21 to the left to disengage the jaw releaser hook 17 of the jaw releaser 15 from the stop jaw 22 of the jaw releaser stopper 20.

The jaw releaser 15 is now pulled downwards by the weight of the quadrilateral links through the spring 19 until supported by the guide pin 3 fixed on the lifting bracket.

The upper jaw lever 6 comes downwards until its gripping jaw 9 touches the lower jaw 10 of the lower jaw lever 8. (FIG. 2)

The apparatus is now in the state of no load, and ready for loading operation as already described.

Thus the device is able to hold or release a drum automatically only by lifting and lowering its lifting bracket.

I claim:

1. An apparatus to hold and transport a drum by gripping and releasing its chime automatically, consisting of a lifting bracket, which is to be installed on a fork lift or other lifting device, of a gripper bracket, equipped with a chime gripping device, consisting of said gripper bracket, of a pair of gripping levers, each of which, having a gripper jaw to grip the chime of a drum and of a connecting lever, these four members being pin jointed with each other to make a quadrilateral link mechanism and suspended by said lifting bracket through a spring at one side and also at the other, supported vertically freely by said lifting bracket through a pin-elliptical hole joint, so as to swing and to be able to shift to and hold the most suitable position automatically to conform to various conditions during the operation, and equipped with a releasing device, consisting of a jaw releaser with a hook at its top end and vertically freely supported by said lifting bracket through a pin-elliptical hole joint and at its bottom end being connected with said quadrilateral link by a spring, of a jaw releaser stopper, equipped with a disengaging slider to release said jaw releaser off a stop jaw of a jaw releaser stopper, which is equipped at the top right corner of said gripper bracket and of a disengaging slider pusher, fixed at the upper side of said lifting bracket, to push said disengaging slider.

2. An apparatus to hold and transport a drum by gripping and releasing its chime automatically, consisting of a lifting bracket, which is to be installed on a fork lift or other lifting device, of a gripper bracket, equipped with a chime gripping device, consisting of said gripper bracket, of a pair of gripping levers, each of which has a gripper jaw to grip the chime of a drum and of a connecting lever, these members being pin jointed with each other to provide a quadrilateral link and being suspended by said lifting bracket through a spring at one side, and at the other side being supported vertically freely by said lifting bracket through a pin-elliptical hold joint, so as to swing and to be able to shift to and hold the most suitable position automatically to conform to various conditions during the operation, and equipped with a releasing device, consisting of a jaw releaser with a hook at its top end and vertically freely supported by said lifting bracket through a pin-elliptical hole joint and at its bottom end being connected with said quadrilateral link by a spring, of a jaw releaser stopper, equipped with a disengaging slider to release said jaw releaser off a stop jaw of a jaw releaser stopper, which is equipped at the top right corner of said gripper bracket and of a disengaging slider pusher, fixed at the upper side of said lifting bracket, to push said disengaging slider.

* * * * *